United States Patent [19]

Tamura

[11] 4,453,061

[45] Jun. 5, 1984

[54] CAPACITANCE TYPE SWITCH HAVING DUST-FREE INTERIOR

[76] Inventor: Ryutaro Tamura, 10-12 Kawaharada, Tsuzura-machi, Uchigo, Iwaki-shi, Fukushima-ken, Japan

[21] Appl. No.: 386,613

[22] Filed: Jun. 9, 1982

[30] Foreign Application Priority Data

Jun. 9, 1981 [JP] Japan ..... 56-84703[U]
Jun. 9, 1981 [JP] Japan ..... 56-84704[U]

[51] Int. Cl.[3] ..... H01H 9/04

[52] U.S. Cl. ..... 200/306; 200/159 B; 200/296; 200/302.2

[58] Field of Search ..... 200/302, 306, 296, 159 B, 200/DIG. 1; 340/365 C

[56] References Cited

U.S. PATENT DOCUMENTS 3,478,857 11/1969 Linker ..... 200/302 X
3,898,421 8/1975 Suzumura ..... 200/306 X
3,904,887 9/1975 Hagelbarger ..... 340/365 C X
3,965,399 6/1976 Walker, Jr. et al. ..... 340/365 C X
3,995,126 11/1976 Larson ..... 200/306 X
4,033,030 7/1977 Robinson et al. ..... 200/159 B X
4,072,840 2/1978 Daigle ..... 200/296
4,227,238 10/1980 Saito ..... 200/296 X
4,345,119 8/1982 Latasiewicz ..... 200/159 B X
4,370,533 1/1983 Kamei et al. ..... 200/159 B X

*Primary Examiner*—John W. Shepperd
*Assistant Examiner*—Renee S. Kidorf

[57] ABSTRACT

A novel capacitance type switch has a completely dust proof structure and ensures smooth switch operation. The switch comprises a stem supporting a movable contact and slidably inserted into a switch case; a plurality of holes formed in the switch case around the stem so as to permit air to pass therethrough into and out from the switch case; a cover surrounding the holes and in intimate contact with the switch case so that the inside of the switch case can communicate with the inside of the cover; the cover being made of a resilient material; and a dust filter made of a seal material interposed between the inside of the switch case and the atmosphere.

6 Claims, 6 Drawing Figures

CAPACITANCE TYPE SWITCH HAVING DUST-FREE INTERIOR

BACKGROUND OF THE INVENTION

This invention relates to a capacitance type switch and more particularly, to a capacitance type switch having a dust proof structure.

A heretofore known capacitance type switch includes flat sheet-like fixed electrodes and a movable electrode coated with a thin insulating film, and is turned to its on state when the movable electrode is brought close to the fixed electrodes so that these fixed electrodes are coupled by electrostatic capacitance via the movable electrode. The switch is turned to its off state when the movable electrode is withdrawn far enough from the fixed electrodes so as to substantially eliminate the electrostatic capacitance between the two fixed electrodes. To maximize the electrostatic capacitance generated when the movable electrode is pushed towards the fixed electrodes and to keep the capacitance type switch under a stable ON state, both movable electrode and fixed electrodes have a flat sheet-like form so that they come into intimate contact with one another via the insulating film. If contact between them is somehow deteriorated as when dust in the air or the like builds up on the movable electrode or on the fixed electrodes, the performance of the capacitance switch may deteriorate to a point where the switch will not function. For this reason, a capacitance type switch generally has a dust proof structure.

FIG. 1 is a sectional view of a typical example of the heretofore known capacitance switches. A plurality of capacitance switches are generally disposed on a printed circuit board, such as the bottom plate of a keyboard, represented by reference numeral 1, though only one switch is shown in the drawing. Two fixed electrodes 2, 3 are disposed on the printed circuit board 1 in a spaced-apart relation so that one serves as the input with the other serving as the output. A case 4 of synthetic resin is fitted to the printed circuit board 1 to encase the fixed electrodes 2, 3, and is equipped with a window 4*a* at its upper end. A stem 5 of synthetic resin penetrates through this window 4*a*. A flange 5*a* is formed at the lower end of this stem 5 and a hole 5*b* is formed at the center of the lower end of the stem. A key top 6 having a display character or mark on the surface is fitted to the upper end of the stem 5. The upper end of a rubber cover 7 fits into the hole 5*b* at the lower end of the stem 5. This cover 7 has a bell-like shape as depicted in FIG. 2 and has a notch 7*a* for air to flow through at its lower end. A movable electrode member 8 made of metal is fitted inside the cover 7, with an insulating layer 9 consisting of a synthetic resin film formed on the lower surface of the electrode member 8.

In the state shown in FIG. 1, the stem 5 and the electrode member 8 are urged upwardly by the resiliency of the cover 7' and the switch is kept in its off state. To turn the switch to its on state the key top 6 is depressed to push the stem 5 downwards. At this time, the cover 7 is depressed and the air inside it jets out through the notch 7*a*. When the key top 6 is released from the pushing force, the cover 7 pushes the stem 5 upwardly by its resiliency and returns to the state shown in FIG. 1. At this time, any fine dust that may have entered the case from the gap between the stem 5 and the window 4*a* of the case and has stayed there is sucked into the cover through the notch 7*a* and reaches the fixed electrodes 2, 3 and the electrode member 8, thus impeding smooth switch operation from time to time.

To eliminate such a problem, one possible countermeasure would be to interpose the cover 7 between the lower end of the key top 6 and the upper surface of the case 4 so as to encase the stem 5 and the window 4*a*. However, because the notch 7*a* communicates the interior of the case with the ambient atmosphere which likely contains much dust, dust is likely to pass through the gap between the stem 5 and the window 4*a* and thus enter the case 4. If the notch is removed in order to avoid such a problem, air cannot move into and out from the cover 7 and so the stem can no longer be easily moved upwardly and downwardly.

SUMMARY OF THE INVENTION

Accordingly, the present invention is primarily directed to provide a novel capacitance type switch which eliminates such problems with the prior art devices and, has a complete dust-proofing structure to prevent the invasion of dust to the electrode portions and ensures a smooth and complete switching operation.

The above and other objects and features of the present invention will become more apparent from the following description in conjunction with the accompanying drawings, in which like reference numerals are used to identify like constituents as in FIGS. 1 and 2.

DESCRIPTION OF THE PREFERRED EMBODIMENTS

Figure 1:
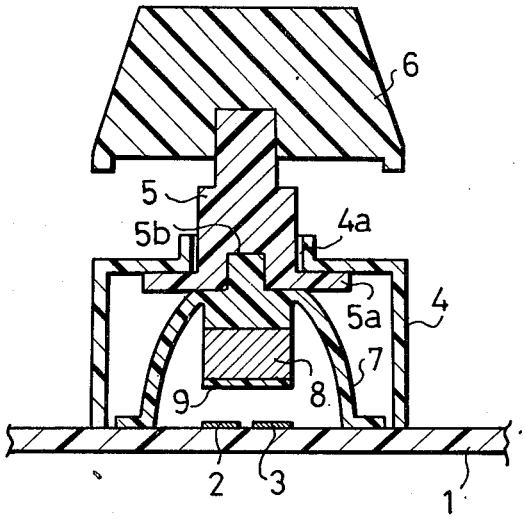
Fig. 1 PRIOR ART
FIG. 1 is a sectional view of the capacitance type switch of the prior art.
Figure 2:
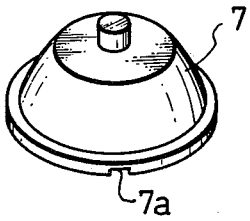
Fig. 2 PRIOR ART
FIG. 2 is a perspective view of the cover of the switch of FIG. 1.
Figure 3:
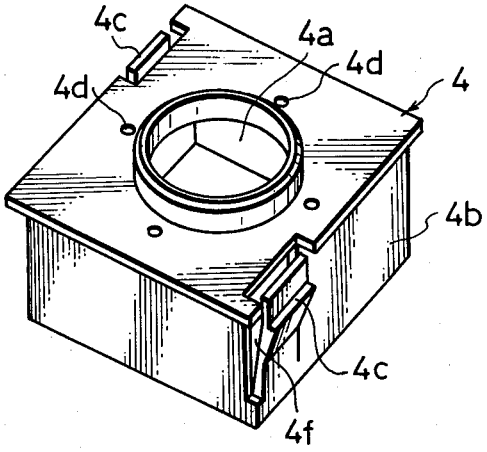
FIG. 3 is a perspective view of the case of a switch in accordance with an embodiment of the present invention.
Figure 4:
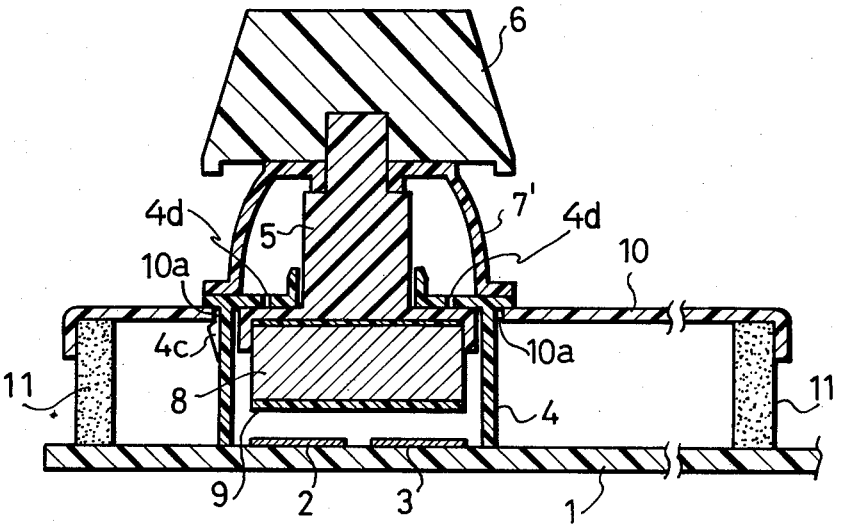
FIG. 4 is a sectional view of the switch of the present invention.

FIG. 3 is a perspective view of the case 4 to be used in an embodiment of the present invention. Engaging plates 4*c* engaging the panel (described below) with the case 4 and gap holes 4*f* for permitting external air to pass through are disposed on the side walls 4*b* of the case 4 in a manner to oppose each other diametrically. Holes 4*d* are formed around the window 4*a* at the center of the case 4, and penetrate to the interior of the case 4. FIG. 4 is a sectional view of the capacitance type switch of the present invention when it is assembled. The cover 7' is made of rubber in the same way as in the prior art device but does not have any notches at its lower end. The upper end of the cover 7' is fitted to the upper end of the stem 5 and is tightly held by the key top 6 fitted to the upper end of the stem 5 so that the cover 7' is kept in intimate and air-tight contact with the upper end of the stem 5 and prevents entry of dust or the like. The lower end of the cover 7' is tightly bonded to the upper surface of the case 4 by an adhesive or the like so as to also be air-tight with the case 4. The holes 4*d* are surrounded by the lower end of the cover 7′ and the inside of the case 4 communicates with the inside of the cover 7′ via the holes 4*d*. There is no gap at all between the upper surface of the case 4 and the lower end of the cover 7′.

Reference numeral 10 represents a panel, which consists of a synthetic resin plate. A plurality of holes 10*a* for receiving respective capacitance switches are formed in the panel 10. The panel 10 is fixed to spacers (not shown) that are implanted in the printed circuit board 1 with a predetermined gap between them. A seal material 11 consisting of a porous material such as foamed polyurethane is disposed around the panel 10. The case assembly 4 including the stem 5 having the moving electrode member 8, the cover 7′ and the key top 6 are inserted into the holes 10*a* from above and assembled to the panel 10 as the engaging plates 4*c* disposed on the side walls 4*b* of the case are hooked to the lower end of the periphery of the window 10*a*.

Next, the switch operation will be described.

In the state shown in FIG. 4, the capacitance switch is kept OFF as the stem 5 and the key top 6 are urged upwardly due to the resiliency of the cover 7′. When the key top 6 is depressed from this state, the stem 5 lowers and the movable electrode member 8 is pushed onto the fixed electrode 2, 3, thereby turning the capacitance switch on. Meanwhile, the cover 7′ has been pushed downwardly by the key top 6 and the air inside the cover 7 escapes into the case 4 through the holes 4*d*. When the key top 6 is no longer pressed downwardly, the key top 6 and the stem 5 are urged upwardly by the resiliency of the cover 7′ and the movable electrode member 8 is removed from the fixed electrodes 2, 3, thus turning the capacitance switchoff. During this time, the cover returns to the state shown in FIG. 4 due to its own resiliency and the air inside the case 4 and between the panel 10 and the printed circuit board 1 enters the cover 7 through the holes 4*d*. As air becomes scarce inside the case 4 and between the panel 10 and the printed circuit board 1, external air enters through the seal material 11. In this case, the seal material 11 serves as a filter and prevents external dust from entering the case so that the inside of the case is kept clean. Accordingly, no dust attaches to the fixed electrodes and the movable electrode even when the capacitance switch is operated.

In the embodiment described above, the seal material is disposed around the panel. If the capacitance switch used is as a single member, however, the seal material may be interposed between the case and the holes 4*f* *through which the external air flows.*

It is of course possible to use other filter materials besides foamed polyurethane, which is merely illustrative.

Figure 5:
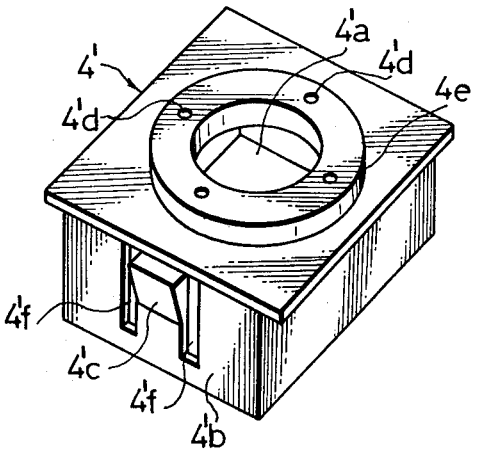
FIG. 5 is a perspective view of the case of a switch in accordance with another embodiment of the present invention.
Figure 6:
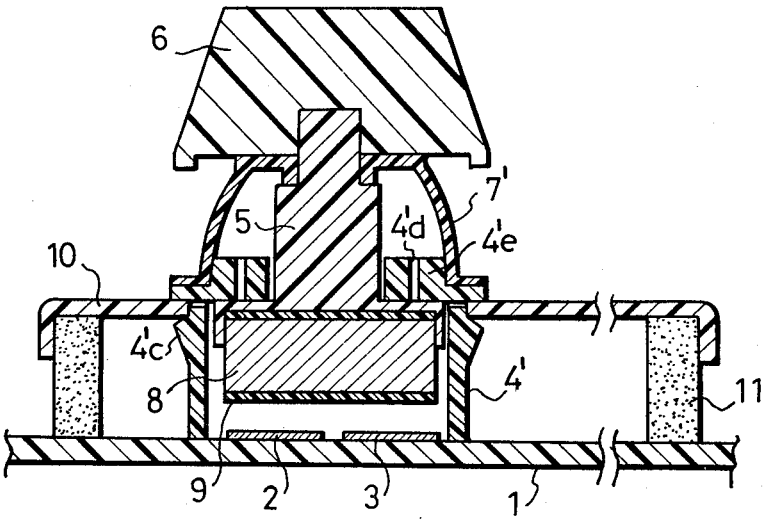
FIG. 6 is a sectional view of a switch in accordance with still another embodiment of the present invention.

FIG. 5 is a perspective view of the case 4′ to be used in another embodiment of the present invention. The engaging plates 4*c* for engaging the panel (described below) with the case 4′ and the gap holes 4*f* for permitting external air to pass through are formed on the opposite side walls 4*b* of the case 4. A step portion 4*e* is formed around the window 4*a* at the center and the holes 4*d* are formed on the step portion 4*e* and penetrate to the inside of the case 4. FIG. 6 is a perspective view of the capacitance switch under the assembled state in accordance with still another embodiment of the present invention. The cover 7′ is made of rubber in the same way as in the prior art device but is not equipped with any notches at its lower end. The upper end of the cover 7′ is fitted to the upper end of the stem 5 and is held by the key top fitted to the upper end of the stem 5 so that the cover 7′ is in intimate contact with the upper end of the stem 5 without any gap and no dust can enter. The lower end of the cover 7 is fitted to the outer circumference of the step portion 4*e* disposed around the central window 4*a* of the case 4 in intimate contact therewith without any gap between them so no dust can enter. The inside of the cover 7 communicates with the inside of the case 4′ via the holes 4*d* formed on the step portion 4*e*. Reference numeral 10 represents the panel, which consists of a synthetic resin plate. The panel is fixed to spacers (not shown) implanted in the printed circuit board 1, with a predetermined gap with respect to the printed circuit board 1. The seal material 11 consisting of a porous material such as foamed polyurethane is disposed around the panel 10. The case assembly 4′ including the stem 5 having the movable electrode member 8, the cover 7′ and the key top 6 are inserted into the case-receiving port of the panel 10 from above the panel and assembled to the panel 10 as the engaging plates 4*c* formed on the opposing side walls 4*b* of the case are hooked to the lower end of the periphery of the case-receiving port of the panel 10.

The operation of this embodiment is that same as the described for the embodiment shown in FIG. 4. In the state shown in FIG. 6, the capacitance switch is kept OFF. When the key top 6 is depressed from this state, the stem 5 lowers and the movable electrode member 8 is pushed against the fixed electrodes so that the capacitance switch is turned on. During this depression′ the cover 7′ is pushed by the key top 6 and the air inside the cover 7′ is discharged into the case 4′ through the holes 4′*d*. Thereafter, the air inside the case 4′ can easily flow outside the case through the gap holes 4*f* bored on the side walls 4*b* of the case so that the key tip 6 can be rapidly pushed without any resistance.

When the key top 6 is no longer pushed, the key top 6 and the stem 5 move upwardly due to the resiliency of the cover 7′ and, at the same time, air outside the case 4′ is sucked into the case via the gap holes 4′*f* and enters the cover 7′ through the holes 4′*d*. Hence, the key top 6 and the stem 5 can easily return to the OFF state shown in FIG. 6. The external air sucked in this case stays inside the case 4 and between the panel 10 and the printed circuit board 1. Since the seal material 11 serves as a filter and removes dust from this air, the case is always filled with clean air. Accordingly, no dust attaches to the surface of the moving electrode member 8 or those of the fixed electrodes 2, 3 when the capacitance switch is operated.

As described in detail in the foregoing, because the gap between the stem and the case through which dust is likely to penetrate is covered with the cover in the present device, no dust at all enters the case through this portion. Moreover, because the air inside the cover is communicated with the air inside the case via the holes, the air inside the cover can easily escape into the case and vice versa. Hence, the capacitance switch operates smoothly. Since the filter material is interposed between the case and the atmosphere, air inside the case is replaced with external air when the capacitance switch is operated so that the dust is checked by the filter material and cannot enter the case. Accordingly, the inside of the case is always kept clean and the moving electrode member can be brought as close as possible to the fixed electrodes via the insulating layer, stabilizing the operation of the capacitance switch.

When the step portion is formed on the case and the lower end of the cover is fitted to the outer periphery of the step portion as in the embodiment shown in FIG. 6, the quantity of air inside the cover can be reduced by the volume of the step portion having the holes so that the inflow and outflow of the air can be made rapidly and the key operation has a better feel. As the cover is made of rubber and is flexible, disposing the step portion also makes the locating work easier and simplifies the assembly procedures.

I claim:

1. A capacitance type switch comprising:

a stem carrying a movable contact and slidably inserted into a switch case;

a plurality of holes formed in said switch case in an area around said stem so as to permit air to pass into and out from said switch case;

a resilient cover held to said stem and surrounding said holes, said cover being in air-tight contact with said switch case so that the inside of said switch case can communicate with the inside of said cover through only said holes; and a filter made of a seal material and interposed between the inside of said switch case and the atmosphere.

2. The capacitance type switch as defined in claim 1 wherein said filter material is foamed polyurethane.

3. A capacitance tpye switch comprising:

a stem carrying a movable contact and slidably inserted into a switch case;

a plurality of holes formed in said switch case in an area around said stem so as to permit air to pass into and out from said switch case;

a resilient cover held to said stem and surrounding said holes, said cover being held in intimate contact with said switch case so that the inside of said switch case can communitcate with the inside of said cover;

engaging plates disposed on the side walls of said switch case, said engaging plates being spaced from said switch case to form holes for the passage of air into said switch case;

said engaging plates of said switch case engaging a panel supported in spaced relation on a printed circuit board; and a filter made of a seal material placed around said switch case and interposed between said printed circuit board and said panel.

4. A capacitance type switch comprising:

a stem a carrying movable contact and slidably inserted into a switch case;

a step portion formed on the surface of said switch case and having holes formed therein to pentetrate to the inside of said switch case;

a cover made of a resilient material and having one end held to said stem and the other end fitted in air-tight relation with the outer periphery of said step portion;

the inside of said switch case being adapted to communicate with the inside of said cover via said holes only;

gap holes formed on the side walls of said switch case; and a filter material formed of a seal material and interposed in said gap holes between the inside of said switch case and the atmosphere.

5. The capacitance type switch as defined in claim 4 wherein said filter material is made of foamed polyurethane.

6. A capacitance type switch comprising:

a stem carrying a movable contact and slidably inserted into a switch case;

a step portion formed on the surface of said switch case and having holes formed therein to penetrate to the inside of said switch case;

a cover made of a resilient material and having one end in intimate contact wih said stem and the other end fitted to the outer periphery of said step portion;

the inside of said switch case being adapted to communicate with that of said cover via said holes;

engaging plates for permitting the external air to pass therethrough, said engaging plates being disposed on the side walls of said switch case and spaced therefrom to form holes for the passage of air into said switch case;

said engaging plates of said switch case being anchored to a panel supported on a printed circuit board with a predetermined gap between them; and a filter material made of a seal material placed around said switch case and interposed between said printed circuit board and said panel.

* * * * *